United States Patent [19]

Rochmann

[11] 4,057,969

[45] Nov. 15, 1977

[54] METHOD AND DEVICE FOR OBTAINING A WATER-TIGHT SHIELD IN THE SOIL WITH THE USE OF NOZZLES

[75] Inventor: Jacques Rochmann, Boulogne, France

[73] Assignee: Soletanche, Paris, France

[21] Appl. No.: 699,595

[22] Filed: June 24, 1976

[30] Foreign Application Priority Data

July 3, 1975 France ..... 75.20921

[51] Int. Cl.[2] ..... E02D 5/20

[52] U.S. Cl. ..... 61/35; 61/53.64

[58] Field of Search ..... 61/53.74, 56.5, 53.52, 61/53.58, 53.7, 53.68, 56, 59, 53.66, 53.64, 35, 36 R; 175/67, 422

[56] References Cited

U.S. PATENT DOCUMENTS

| | | | |
|---|---|---|---|
| 3,540,225 | 11/1970 | Muller | 61/53.64 X |
| 3,851,490 | 12/1974 | Matsushita | 175/67 |
| 3,852,971 | 12/1974 | Phares | 61/53.74 X |
| 3,973,408 | 8/1976 | Paverman | 61/35 |

*Primary Examiner*—Dennis L. Taylor

*Attorney, Agent, or Firm*—Cooper, Dunham, Clark, Griffin & Moran

[57] ABSTRACT

A method and a device for obtaining a water-tight shield in a soil apt to being disintegrated by liquid jets, by driving a tool into the soil and filling the furrow left by the tool while it is taken off, by a settable mortar, the operation being repeated step by step so that the tool every time encroaches upon the shield portion obtained during the preceding operation. The tool is driven into the soil through the injection of a settable grout used for disintegrating the soil, which supports the walls of the excavation and is mixed with the disintegrated soil so as to provide a mortar which after setting will form the impervious shield, the injection of grout being carried on during taking off of the tool.

18 Claims, 3 Drawing Figures

III
III
5
6
7
13
14
15
16
17
18
19
20
21
22
23
24
25
26
27
28
29
30
31
32
33
34
35
36
37
38
39
40

METHOD AND DEVICE FOR OBTAINING A WATER-TIGHT SHIELD IN THE SOIL WITH THE USE OF NOZZLES

The present invention relates to the formation of water-tight shields or screens in the soil, more particularly comparatively thin shields of this type, i.e. having a thickness which is relatively small in comparison to other dimensions, such as a few centimeters or decimeters for example.

It has already been proposed to form an impervious shield by driving through the soil a tool associated with an injection pipe, and by filling with a settable mortar the furrow which the tool leaves in the soil when it is pulled off; the operation is repeated step by step as many times as necessary, taking care every time that the tool encroaches upon the furrow or cavity left by the preceding operation (French Pat. No. 1,469,001 in the name of the Applicant).

A process is also known (French Pat. No. 1,458,165 in the name of the Applicant) in which a tool is displaced longitudinally in the soil, the tool comprising a frame supporting an endless chain on the one hand, provided with teeth which disintegrate the soil and an injection device on the other hand for a hardenable or settable binder, so that mixing of this binding material with the disintegrated soil forms a mortar which sets in the soil for forming the desired shield.

Such methods have as shortcoming that in practice they do not reach a greater deepness than 10 to 15 meters.

It is an essential object of the present invention to provide a method and a device allowing the formation of thin, inexpensive and impervious shields, the depth of which may reach several scores of meters in soils capable of being disintegrated by liquid jets, i.e., more especially, soils with a low or null cohesion and with a fine granulometry, such as sand or gravel.

According to the invention, there is provided a method in which a tool is driven in the soil, having a thickness and length which respectively correspond to the width and deepness of the shield to be obtained, liquid jets being used for the purpose, which issue from the under part of the tool, for disintegrating the soil, the liquid consisting of a settable grout which on the one hand ensures supporting of the walls of the excavation, and on the other hand, by mixing with the disintegrated soil, forms a mortar which will constitute the water-tight shield.

Just as in the first known method mentioned at the beginning of this specification, the tool is pulled off the ground and then it is driven again in the ground in the same way, but in such manner that the furrow left in the soil partially encroaches the shield portion obtained during the preceding operation, and this operation is repeated until the shield has acquired the desired length.

Advantageously, the grout is used in an open circuit, i.e. without recycling said grout, which spares the need of a scrubber unit, means being provided for allowing the bulging of the mortar for example in a low deep trench at the upper edge of the shield, which will be thus finally reinforced.

Boring with the use of nozzles in a favourable soil, well adapted to applying the method of the invention entails the use of jets with a high flow rate and under relatively low pressures, which is a priori in conflict with the use of the grout in open circuit.

According to the invention this problem is solved by providing a grout supply with a lower flow rate and under a higher pressure, but with a tool fitted with hydraulic transformers which locally increase the flow rate whilst lowering the pressure.

For example, instead of a flow rate of 60 liters per second under a pressure of 10 bars, the use of hydraulic transformers allows a grout supply of 20 liters per second under 60 bars with satisfactory results.

The device used according to the invention for the working of the above described method preferably comprises a tool formed with parallel tubes united by thin struts and fitted with nozzles at the lower part. This ensures a good penetration of the tool and further allows the formation of the shield in driving the rear tube in the mortar column, which has not yet set, produced by the front tube during the preceding process.

The tool is advantageously formed with members which may be connected end to end, namely a head member connected to a grout supply, a tail member provided with required nozzle means and one or more intermediate members acting as extensions, these various members being imperviously united together for ensuring the required mechanical and hydraulic continuity.

An embodiment of the invention will now be described by way of example and with reference to the accompanying drawings in which.

In the example shown on the drawings, the device comprises a head member 1, a tail member 2 and in case of need one or more intermediate members or extensions 3, according to the depth which is to be reached.

Figure 1:
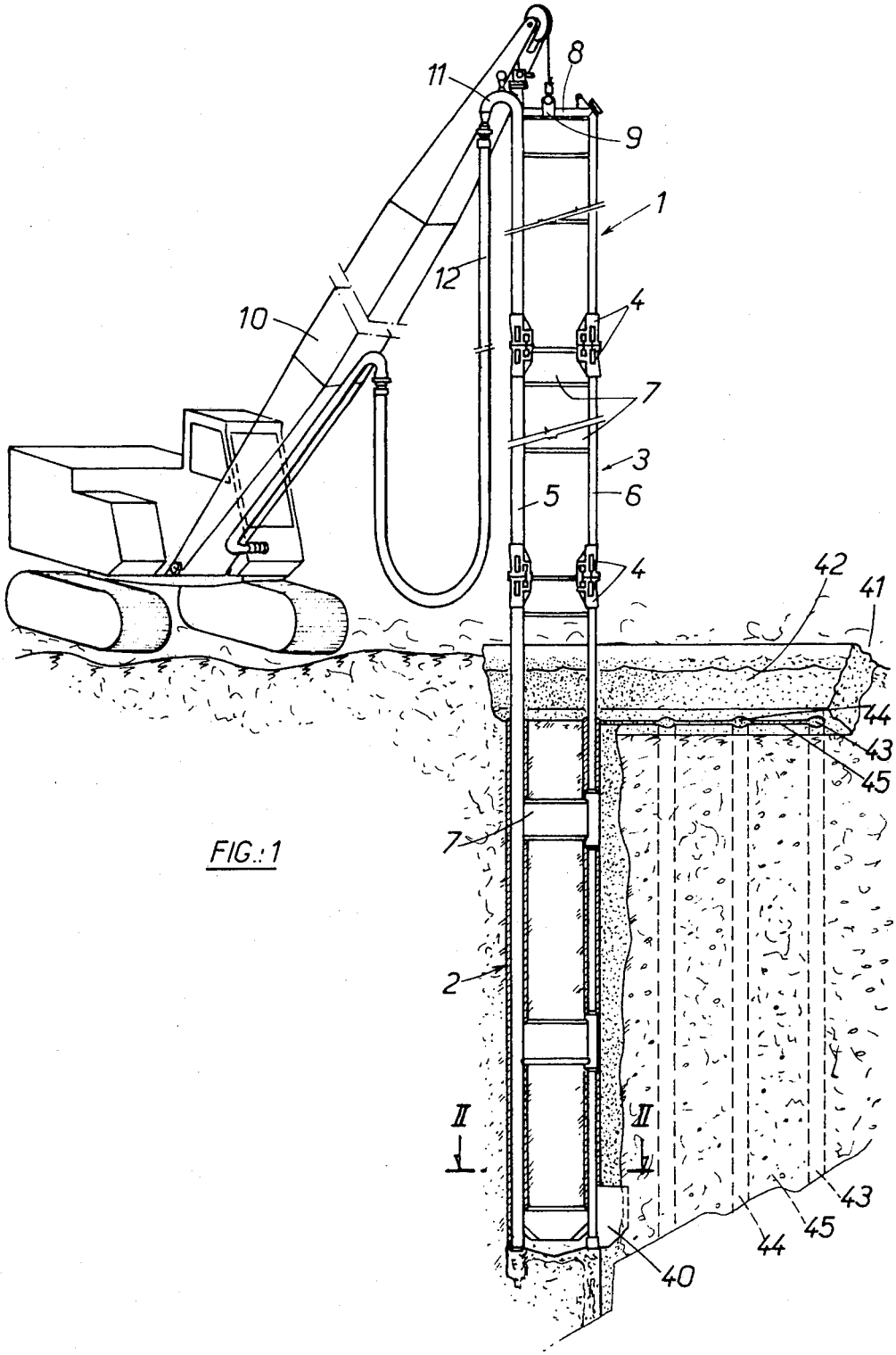
FIG. 1 is a schematic view showing a device according to the invention, for illustrating the working of the method of the invention.
Figures 2, 3:
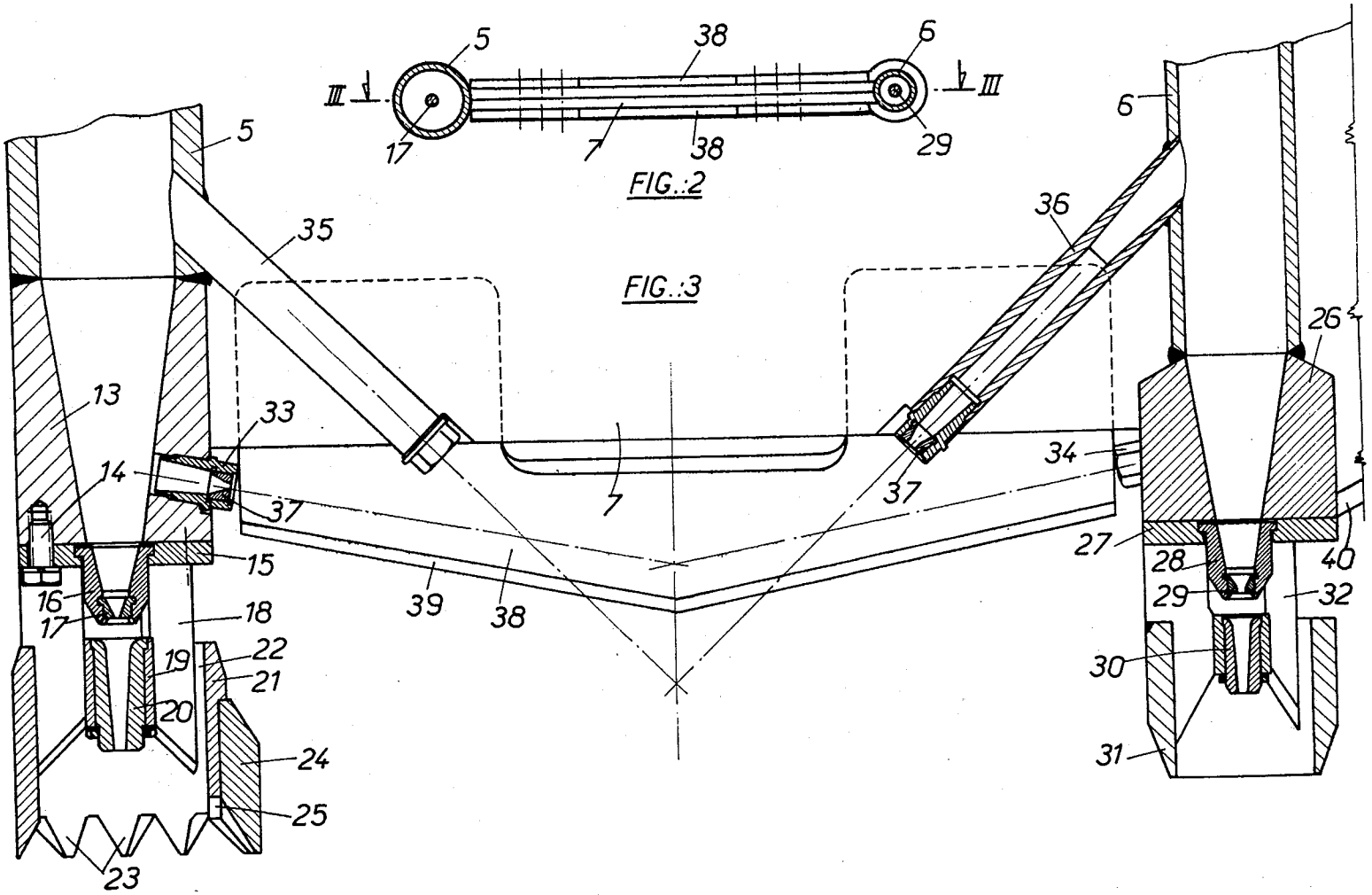
FIG. 2 is a section view to a greater scale along II—II of FIG. 1.
FIG. 3 is a section view along III—III of FIG. 2.

All these members are to be connected end to end by means of complementary joints 4 which protrude transversally only slightly so as to form two parallel tubes, namely a principal tube 5 and a secondary tube 6 (FIG. 1). Said tubes are held apart at the required distance by means of thin flat struts 7 located in their common median plane, the thickness of which is less than the diameter of the tubes, as illustrated in FIG. 2. The diameter of secondary tube 6 is less than the one of principal tube 5. In the head member 1, the principal tube 5 is connected to secondary tube 6 by a hollow beam 8 (FIG. 1) which not only establishes the communication between the tubes, but further forms a transversal rail to which there can be affixed at a changeable position a suspension piece 9 acting for suspending the device to the boom of a hoisting machine such as a crane 10. The changeability of the hooking position allows for modifying the balance of the tool to ensure its uprightness or to restore it.

In the head member also is the principal tube 5 prolongated by a swan-neck 11 connected to a grout supply hose 12, which is connected in its turn to a grout supply not shown (FIG. 1).

Extensions 3 are formed with two tube members suitably connected by struts 7 and fitted at their end parts with connecting parts 4. They may have various lengths, and a variable number of them may be used according to each case.

In the tail member, the end of the principal tube 5 has the form of a converging socket 13 coaxial with the tube, and coaxially fixed thereon by means of a screw 14 is a jet nozzle member 15 supporting in place a nozzle holder 16 with an interchangeable nozzle 17.

Around the nozzle-holder 16 the member 15 comprises radially disposed ribs 18 which support a hydraulic transformer consisting of a centrally disposed twyer-holder 19 for supporting a converging twyer coaxial to and spaced apart of nozzle 17 and an outer sleeve 21, the diameter of which is somewhat greater than tube 5 and socket 13.

Passages 22 are provided between ribs 18, nozzle-holder 19 and sleeve 21.

The sleeve 21 extends from a point a little beneath the level of the central twyer inway down to a point lower than its outlet, as illustrated in FIG. 3. Its lower edge is provided with sharp teeth 23, the outer side walls of which are cylindrical, and the inner walls are frustoconical and diverging, so that the sleeve may act as a profiling shoe. In the median plane of the tool, the sleeve 21 further comprises a projection 24 directed towards the secondary tube 6, the lower edge of this projection forming a big tooth which faces a cut 25 in the sleeve edge.

On a similar way, the end of the secondary tube 6 has the form of a converging socket 26 on which is a nozzle member 27 affixed for supporting in place a jet nozzle-holder 28 with an interchangeable nozzle 29 (FIG. 3).

The member 27 also includes a hydraulic transformer formed with a centrally disposed twyer-holder fitted with a converging twyer 30 and a coaxial sleeve 31 of an outer diameter substantially equal to the socket 26, the assembly being suitably spaced apart from nozzle 29 and supported by radially disposed ribs 32. The lower edge of the sleeve 31 is bevelled outwardly so as to act as a centering shoe.

In both sockets 13 and 26, and in the tubes 5 and 6, slightly under these sockets, there are inserted in the median plane of the tool jet nozzles 33, 34, 35 and 36 fitted with interchangeable nozzles 37, which converge symmetrically obliquely downwards by pairs, as illustrated in FIG. 3.

On the lower strut 7 of the tail member cutting knives 38 are affixed and disposed on both sides of the four jet nozzles 33, 34, 35 and 36, for limiting the effect of said jet nozzles. The lower edges 39 of knives 38 are formed in herring-bone pattern so as to be substantially parallel to the jets of the lower nozzles 33, 34, the jets of the nozzles 35 and 37 converging beyond the edges of knives 38.

On the side of tube 6, opposite to tube 5, in the mean plane of the tool, a guiding rib 40 is provided and clearly to be seen in FIG. 1.

The above described equipment can be used as follows:

In the soil 41, at the place where the impervious shield is to be obtained, a trench 42 of small extension is dug, (FIG. 1), for example by means of a power-shovel. This trench may be e.g. one meter deep and 0.60 meter wide. It acts as bulging space for the mortar formed during the operation of the tool.

The disintegration of the soil, which results from the ejection of grout through the several nozzles of the tail member being made use of, the tool is driven down into the soil to the desired depth, extensions 3 being added when necessary. Without interrupting injection, the tool is hauled up; thus a first wall portion is obtained and formed of two substantially cylindrical columns 43 and 44 bridged together by a veil 45.

The tool is then driven into the soil with the secondary tube 6 entering into the uncompletely set column 44 which was produced by the principal tube during the preceding step, the rib 40 ensuring an additional guiding security and this process is repeated until the shield is completed.

The hydraulic transformers 19–21 and 30–31 operate according the known principle of the hydroejector, with the particular feature that after mixing of the high pressure fluid going out of the nozzle 17 or 29 with the aspirated fluid, there is no conversion of the kinetic energy into potential energy, since the energy operates directly on the soil in a kinetic way. Homogeneization of the mortar is secured thanks to the high pressure of the initial jet going out of the nozzles and the multiple recycling caused by the hydraulic transformers. The grout can be formed with water, cement and bentonite or equivalent fine clay.

The optimum perforation conditions are to be obtained, taking the nature of the soils passed through into consideration, by adjusting the several perforation parameters such as grout flow, pressure, nozzle diameters, driving-in speed, hydraulic transformer diameters and location of calibrating and centering sleeves.

The invention is not restricted to the details of the foregoing examples and will be better defined by the appended claims.

I claim:

1. In a method for obtaining a water-tight shield in a soil by driving a tool in the soil and injecting a settable grout to disintegrate the soil, the grout being mixed with the disintegrated soil for providing a mortar which after setting will form said shield, the improvement wherein the grout is injected through an injection nozzle with a comparatively low flow rate under a comparatively high pressure and is then mixed with the soil by a recycling through use of a hydraulic transformer associated with said injection nozzle, said transformer operating to increase the flow and decrease the pressure of the grout with respect to the flow and pressure through said injection nozzle.

2. A method according to claim 1, wherein the grout is used in an open circuit, and a trench larger than the shield is excavated whereinto the tool is to be driven, so as to accommodate bulging of the mortar.

3. In a device for obtaining water-tight shields in soils apt to be disintegrated by liquid jets, by driving a tool into the soil and filling the furrow made by the tool while it is taken off, by means of a settable mortar, the operation being repeated step by step, including a grout supply, a tool connected at its head end to said grout supply and fitted at its tail end with liquid ejection nozzles, and means for supporting said tool, the improvement wherein said tool is formed of tubes parallel to each other and bridged by struts of a thickness less than the tube diameters to permit a rear one of the tubes to be driven into the furrow left by a fore one of the tubes as a result of a preceding operation of the tool.

4. A device according to claim 3, wherein the tubes are fitted with nozzles axially disposed, and with nozzles obliquely disposed located in the mean plane of the tool and converging downwards.

5. A device according to claim 4, including cutting knives, and wherein at least some of said obliquely disposed nozzles are directed so as to eject a liquid between said cutting knives.

6. A device according to claim 5, wherein said cutting knives have lower edges substantially parallel to the jets of liquid therebetween.

7. A device according to claim 4, wherein the axially disposed nozzles are associated with hydraulic transformers each of which comprises a twyer coaxial to and spaced apart from the associated one of said axially disposed nozzles.

8. A device according to claim 7, wherein the hydraulic transformers each include a sleeve coaxial to and surrounding said twyer.

9. A device according to claim 8, wherein each of said sleeves has an outer diameter greater than that of the corresponding tube.

10. A device according to claim 7, including at least two of said tubes, one of the tubes having a diameter less than another, and the hydraulic transformer of said smaller tube being fitted with a sleeve, the outer end of which is bevelled outwardly so as to act as a centering shoe, while the hydraulic transformer associated with said another tube has its outer end fitted with teeth allowing it to act as a profiling shoe.

11. A device according to claim 10, wherein the smaller tube is fitted with a guiding outer rib, directed in the mean plane of the tool.

12. A device according to claim 3, wherein one of the tubes is connected to the grout supply, the other tube being connected to said first tube by means of passage means used for grout supplying and allowing the tool to be suspended to said support means.

13. In a device for obtaining a water-tight shield in a soil and including a tool driven in the soil for injecting a settable grout to disintegrate the soil, the grout being mixed with the disintegrated soil for providing a mortar which after setting will form said shield, the improvement wherein said tool comprises an injection nozzle for injecting grout with a comparatively low flow rate under a comparatively high pressure, a hydraulic transformer associated with said injection nozzle for mixing grout with soil and operating to increase the flow and decrease the pressure of the grout with respect to the flow and pressure through said injection nozzle.

14. A device according to claim 13, wherein said hydraulic transformer comprises a twyer coaxial to and spaced apart from said injection nozzle.

15. A device according to claim 14, including a sleeve coaxial to and surrounding said twyer.

16. A device according to claim 15, wherein said injection nozzle and hydraulic transformer are carried by a tube, said sleeve having an outer diameter greater than that of said tube.

17. A device according to claim 15, in which the outer end of said sleeve is bevelled outwardly so as to act as a centering shoe.

18. A device accoding to claim 15, wherein the outer end of said sleeve includes teeth allowing it to act as a profiling shoe.

* * * * *